United States Patent [19]

Doyle et al.

[11] 4,171,047

[45] Oct. 16, 1979

[54] PACKAGE INCLUDING A CONTAINER AND A LONGITUDINALLY FOLDED PRE-MOISTENED WEB THEREIN

[75] Inventors: Ross L. Doyle, Ramsey, N.J.; Thomas S. Harrison, Deer Isle, Me.

[73] Assignee: Sterling Drug Inc., New York, N.Y.

[21] Appl. No.: 837,884

[22] Filed: Sep. 29, 1977

Related U.S. Application Data

[63] Continuation-in-part of Ser. No. 619,390, Oct. 3, 1975, abandoned.

[51] Int. Cl.[2] ..... B65D 81/22; B65D 85/671

[52] U.S. Cl. ..... 206/210; 206/409; 206/494; 221/63; 225/106; 118/506

[58] Field of Search ..... 206/210, 205, 410, 409, 206/494; 225/32, 106; 221/63; 118/506

[56] References Cited

U.S. PATENT DOCUMENTS

| | | | |
|---|---|---|---|
| 3,795,355 | 3/1974 | Gerstein | 225/32 |
| 3,868,052 | 2/1975 | Rockefeller | 225/106 |
| 3,986,479 | 10/1976 | Bonk | 206/410 |
| 4,002,264 | 1/1977 | Marchesani | 206/205 |

*Primary Examiner*—William T. Dixson, Jr.
*Attorney, Agent, or Firm*—Charles R. Fay

[57] ABSTRACT

A sheet of material having a height greater than the vertical wickability thereof when a bottom edge is in a liquid medium, said sheet being folded one or more times to lessen the effective height of the sheet and providing complete wickability for the entire height of the folded sheet. The sheet in multiples may be in the form of a rolled web, a stack, a folded stack, or in other forms, and is used to provide moistened towelettes.

12 Claims, 5 Drawing Figures

PACKAGE INCLUDING A CONTAINER AND A LONGITUDINALLY FOLDED PRE-MOISTENED WEB THEREIN

This application is a continuation-in-part of corresponding application Ser. No. 619,390, filed Oct. 3, 1975 now abandoned.

BACKGROUND OF THE INVENTION

Some wickable materials when used with certain liquids wick less well than do other materials with the same or other liquids. For example, a certain material will not wick enough to more than barely dampen or leave dry the material at the top of the sheet when it is abstracted, e.g. from a package, even though there may be an appreciable amount of liquid in the container at the bottom thereof.

In some cases, therefore, when the consumer pulls a towelette out of a container, one part of the towelette may be drier than another part, and indeed one part may be quite wet and the other part relatively dry. This is clearly an undesirable situation, and it is the object of the present invention to provide a package containing a longitudinally folded rolled web or folded sheets, etc. of towelette material which thereby overcomes a degree of wickability or lack of wickability which sometimes occurs in certain sheets versus liquid wicking situations. Attention is drawn to our co-pending application, Ser. No. 432,620, filed Jan. 11, 1974, which is a continuation-in-part of certain preceding applications, and which is now U.S. Pat. No. 4,017,002, dated Apr. 12, 1977.

DESCRIPTION OF THE PRIOR ART

Patent to Bonk, U.S. Pat. No. 3,986,479 shows material to be extracted from a container, the material being in the form of a web wound in a roll. This material is enclosed in a vapor impervious pouch to prevent loss of moisture from the pre-moistened towelette roll until the point of time of first use. A double lid is adapted to provide a moisture seal between usages while reducing dehydration of the open towelette pouch within the dispenser.

Bonk does not disclose the presence of any liquid in the bottom of the container, and it is to be inferred by his reference to "impregnated" material that it is of a type which does not present the problem involved in the present case wherein the material of the folded web or sheets does not have wickability of a degree necessary to provide a moistened towelette from top to bottom thereof, unless it is folded as disclosed in the present application.

Rockefeller U.S. Pat. No. 3,868,052, discloses FIG. 18, a horizontal roll having one side always in fluid 24 in the container; and he also discloses in FIG. 2 a vertical coreless roll where the abstraction is from the center and where the bottom of the roll is in the fluid 24. However Rockefeller does not disclose folding. FIG. 2 of Rockefeller shows the construction or package which may be similar to the present, but Rockefeller does not disclose that he was aware of any problem involved in wickability to the top of the roll (say in FIG. 2), so that it has to be inferred that the material and the liquid used in Rockefeller are compatible to the extent that wicking takes place to the top of the roll without any problem such as is described in the present application, nor any particular folding arrangement.

Patent to Nelson U.S. Pat. No. 3,700,138 shows folded sheet material folded about an axis corresponding to a longitudinal center line. This package is adapted to stand on end and the individual tissues may be dispensed longitudinally. This does not indicate any knowledge or appreciation of the wickability problem which leaves the upper edges of the sheets dry and it also does not concern itself with pre-moistened towelettes. In addition Nelson's sheets are not folded longitudinally nor they do not reduce the height of the sheet for use in a short container as described in the present case.

United States patent to Henderson U.S. Pat. No. 2,656,916 and also Gerstein U.S. Pat. No. 3,795,355 fold their sheets in a manner not applicable to the present invention and also they do not present either the problem or the solution of the lack of wickability of certain desirable sheet materials combined with certain desirable liquids as described in the present case.

The following patents are also of interest but do not show the tissues folded as recited in the claims in the present case and do not have the problem or solution recited herein.

Nelson—U.S. Pat. No. 2,611,482
Cordis—U.S. Pat. No. 3,368,522
Harrison—U.S. Pat. No. 3,749,296
British Pat. No. 7,721 of 1899

SUMMARY OF THE INVENTION

An impervious container is provided in which pre-moistened towelette sheets or webbing are inserted and sealed in. The roll or the sheets in general stand vertically within the container, the width of the sheets or web and the height of the roll therefore being in a vertical plane. Excess liquid tends to form in the bottom of the container so that the bottom edges of the sheets or roll will be wetter than their tops.

In the present invention the pre-moistened sheets or web are folded and this has the effect of reducing the effective width of the web, i.e. the relative height of the roll and the height of the sheets and the effect of this is that the individual towelettes are maintained more evenly moist throughout their entire areas than would otherwise be the case. A layer of towelettes is provided that has a relatively short height. In the use of a roll of folded web width is less than the vertical wicking ability with regard to the combination of the particular sheet material and fluid used. This provides useful wickability across the entire width of the roll of the folded web since the width of the roll in the container is generally vertical.

Also, in the case of folded sheets, the towelettes when flat are in greater height than the height of the folded pack of sheets, and there may be as many folds as may be desired or practical.

As a result, the towelettes are and remain thoroughly moist, and the container package can be much shorter in height than where an unfolded web or sheets are employed as in the prior art, or where folded sheets are of a material that wicks throughout.

It is preferred that the pack of sheets or the winds of the roll be in contact, to maintain wicking between the folded parts of the towelettes.

PREFERRED EMBODIMENT OF THE INVENTION

Figure 1:
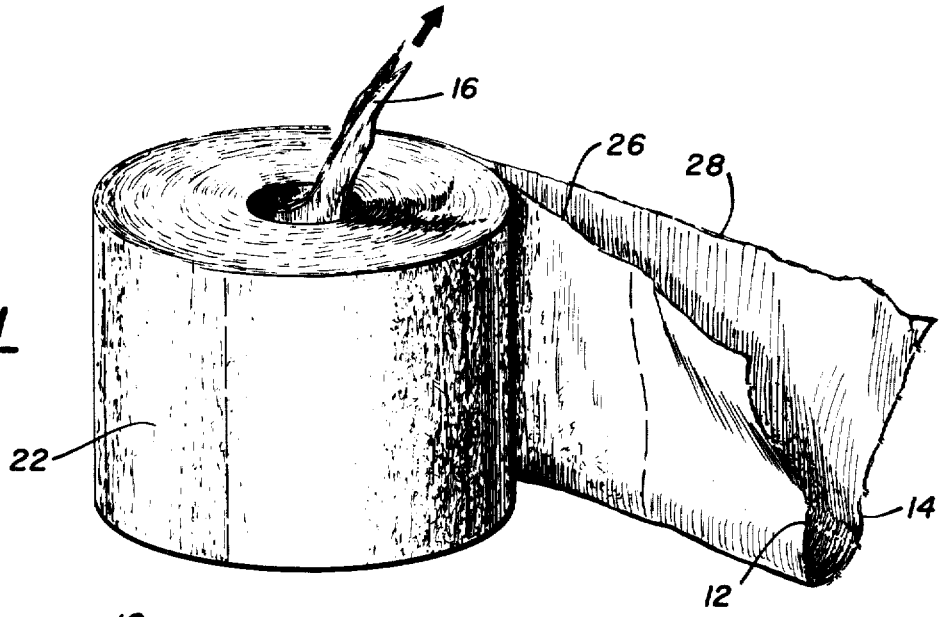
FIG. 1 is a perspective view illustrating a roll of a longitudinally folded web perforated to form towlettes.
Figure 5:
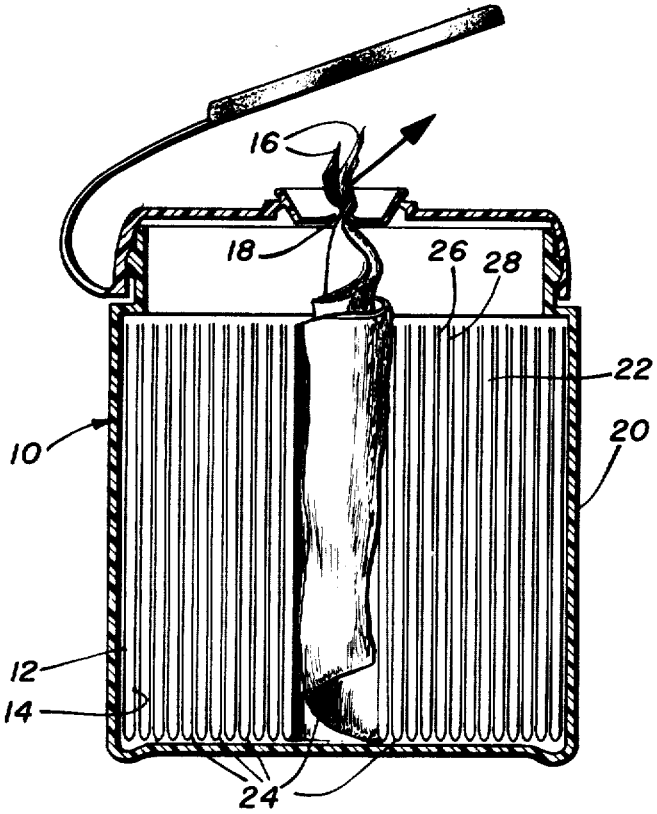
FIG. 5 is a cross-sectional view illustrating a roll of longitudinally folded webbing forming towelettes in a container package.

Although the invention applies to folded sheets as well as perforated webbing, it is illustrated as applied to a coreless roll in FIGS. 1 and 5. In these figures there is shown an elongated web of any kind of suitable wickable material for being pre-moistened for the purposes of the present invention. This material may be of any kind that absorbs liquid material or to which the liquid material may be adsorbed. Such materials are in general well-known in the present art although they may be improved upon. In the present case the elongated web is folded over onto itself longitudinally providing sides 12 and 14 for example.

This web is pre-moistened and rolled corelessly providing a leading tip end here indicated at 16 which is adapted to be extended out through an exit slit or other opening 18 in an impervious container 20. The coreless roll is indicated generally at 22 in the container.

It will be seen that by longitudinally folding the web the width of each towelette is increased relative to its length in the direction of pull to extract it from the container. When the roll is placed in the container the folds of all of the different winds of the roll as indicated at 24 are located at the bottom of the container in contact with the liquid at the bottom of the container, and the free edges as at 26 and 28 are located adjacent to the top of the container. This relation can be reversed. The folds 24 are in the central areas of the individual towelettes. The free edges 26 and 28 might be at the bottom of the container in contact with the liquid, and the longitudinal fold may be at the top, but in any event, each towelette has two parts at the bottom of the container in contact with the liquid instead of only one part.

This means that any tendency due to gravity of the individual towelettes to become more moist at one end than the other is obviated because they become more moist in two areas (or even three or more).

Therefore, the situation is such that the width of the web, which becomes the length of the individual towelette, is less than the vertical wickability of the roll having regard to the material of the roll and the fluid utilized, the web having longitudinally folded configuration which allows useful wickability across the entire width of the roll. This is true even though the width of the web when unfolded has a wickability which is less than its ability to wick fluid material from the lower edge thereof, i.e., the web width may be greater than the vertical wickability when not folded, the wicking ability of the material of the web and the type of fluid being taken in conjunction.

Therefore, in cases where the wickability of the material is in general limited having regard to the fluid or moisture of the material which is utilized, a much better moistened condition of the individual towelettes as they are abstracted from the container is provided, than would be the case where the web is not folded longitudinally. The sheet size may be altered between perforations without altering the height of the container. The height of the container can be altered without changing the sheet size between perforations. Any combination of desired alteration of sheet size or container can be therefore accomplished and will be made according to the particular needs of the particular situation with regard to wickability, i.e., type of liquid versus type of web material.

Figure 2:
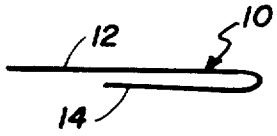
FIGS. 2, 3 and 4 illustrate some ways in which the roll of FIG. 1 or individual sheets may be folded.
Figure 3:
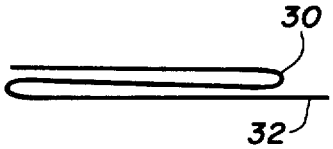
Figure 4:
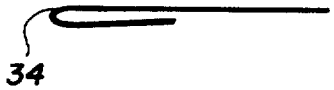

In FIGS. 2, 3 and 4 folds are shown in diagrammatic form which may be applied to webs as described in a roll which is coreless or not, or individual sheets can be folded as shown or in other ways. These sheets may be interleaved for the extration process, bringing up the leading end of a subsequent sheet as the preceeding sheet is abstracted; or the sheets may even be connected and perforated to be torn off one at a time even though not in roll form, but in stack form.

One way of stacking such sheets is to fold them in any way desired in one or more folds, and to then compact them into a U-shape for insertion into the container or package; or it is possible to fold them and then in folded condition stuff them into a container, the extraction process being substantially the same as where the web is folded as shown in FIGS. 1 and 5.

It is preferred that the individual folds are in contacting relationship with each other so that the wicking action is transferred from one layer to another layer. For instance, looking at FIG. 3, the end 32 might be the lowermost end in the package, but as long as the various folds are in contact with each other, the wicking action is transferred from one to the other layer, and will proceed to the opposite edges regardless of whether they are even or overlapped, even though in unfolded form the wickability of the material of the sheet is less than sufficient to carry the liquid from the lower edge to the upper edge.

The same is true as to the single folds shown in FIGS. 2 and 4. The folded edge may be inserted in the fluid as illustrated in FIG. 5 as to the web; but even if the single edge is located in the liquid in the bottom of the container, and the wickability is such that the liquid from the container progresses by osmosis as far as into the area of the fold as for instance at 14 in FIG. 2, then the short fold becomes moistened also.

We claim:

1. A package comprising a container, a plurality of sheets of wickable material therein, said sheets being generally vertical with edges thereof adjacent the bottom of the container, and liquid in the container at the bottom thereof in contact with said edges, the sheets when non-folded having a height greater than the wickability of the sheets with respect to the type of liquid in the container, said sheets being folded so that their heights are less than when in non-folded condition, the nature and quantity of the liquid within the container and the wickability of the sheets being such that wickability will be provided across the entire height of the folded sheets as long as liquid remains in the container in contact with the lower edges of said folded sheets.

2. The package of claim 1 wherein said sheets are formed in a stack.

3. The package of claim 1 wherein said sheets are in the form of a rolled perforated web providing a continuity of folded sheets.

4. The package of claim 3 wherein the roll is coreless.

5. The package of claim 4 wherein the roll has a leading end in the central portion thereof.

6. The package of claim 3 wherein the roll is on a vertical axis.

7. The package of claim 3 wherein the web is folded longitudinally.

8. The package of claim 6 wherein the web is folded more than once.

9. The package of claim 1 wherein the sheets are folded more than once.

10. A package comprising an impervious container, a roll comprising elongated folded web material therein and liquid in the bottom of the container in contact with the bottom of the roll, said web having a width when unfolded which is greater than the vertical wickability with respect to the combination of the material of the web and the liquid being wicked, said web being longitudinally folded on itself thereby reducing the width of the web and the height of the roll, the nature and quantity of the liquid within the container and the wickability of the web material being such that wickability will be provided across the entire width of the folded web material and height of the roll as long as liquid remains in the container in contact with the bottom of the roll.

11. The package of claim 9 wherein the web is once folded.

12. The package of claim 9 wherein the web is folded more than once.

* * * * *